US009004945B2

(12) United States Patent
Nagata et al.

(10) Patent No.: US 9,004,945 B2
(45) Date of Patent: Apr. 14, 2015

(54) CONNECTOR AND ELECTRONIC DEVICE

(75) Inventors: Takayuki Nagata, Yao (JP); Hideto Kobayashi, Isesaki (JP)

(73) Assignee: Hosiden Corporation, Osaka (JP)

( * ) Notice: Subject to any disclaimer, the term of this patent is extended or adjusted under 35 U.S.C. 154(b) by 53 days.

(21) Appl. No.: 13/819,381

(22) PCT Filed: Sep. 27, 2011

(86) PCT No.: PCT/JP2011/072038

§ 371 (c)(1),
(2), (4) Date: Feb. 27, 2013

(87) PCT Pub. No.: WO2012/043542

PCT Pub. Date: Apr. 5, 2012

(65) Prior Publication Data

US 2013/0178100 A1 Jul. 11, 2013

(30) Foreign Application Priority Data

Sep. 28, 2010 (JP) ..... 2010-217669

(51) Int. Cl.
*H01R 13/648* (2006.01)
*H01R 13/6594* (2011.01)
(Continued)

(52) U.S. Cl.
CPC ..... *H01R 13/648* (2013.01); *H01R 13/6594* (2013.01); *H01R 13/6596* (2013.01); *H01R 13/506* (2013.01); *H01R 12/724* (2013.01); *H01R 13/516* (2013.01); *H01R 13/6271* (2013.01)

(58) Field of Classification Search
CPC ..... H01R 13/6594; H01R 13/506; H01R 13/516; H01R 13/6271; H01R 12/724
USPC ..... 439/607.35–607.41
See application file for complete search history.

(56) References Cited

U.S. PATENT DOCUMENTS 5,035,652 A 7/1991 Shibano
6,210,237 B1 4/2001 Chang
(Continued)

FOREIGN PATENT DOCUMENTS

CN 1375120 10/2002
EP 1626464 2/2006
(Continued)

OTHER PUBLICATIONS

Search report from E.P.O., mail date is Feb. 27, 2014.
(Continued)

*Primary Examiner* — Khiem Nguyen
(74) *Attorney, Agent, or Firm* — Greenblum & Bernstein, P.L.C.

(57) ABSTRACT

A connector is provided in which a connector member is secured to a case and a shielding effect can be maintained even if a mating plug-type connector to be engaged therewith has a flat insulating plate with connecting portions on both of its faces, forming mutually parallel arrays of pluralities of upper terminals and lower terminals, which are strips of conductive segments. The connector member and the case are included. The connector member includes an inner shield cover that includes engaging portions having press-fractured faces, formed in its rear end. The case has resin springs which are disposed inside the tube-shaped portion of the case and extend toward the back and fixing stops which are disposed at free ends of the resin springs and increase in thickness inward from back to front.

8 Claims, 13 Drawing Sheets

(51) Int. Cl.

| | |
|---|---|
| *H01R 13/6596* | (2011.01) |
| *H01R 13/506* | (2006.01) |
| *H01R 12/72* | (2011.01) |
| *H01R 13/516* | (2006.01) |
| *H01R 13/627* | (2006.01) |

(56) References Cited

U.S. PATENT DOCUMENTS

| | | | | |
|---|---|---|---|---|
| 6,540,563 | B1 | 4/2003 | Hu et al. | |
| 6,609,929 | B2 * | 8/2003 | Kamarauskas et al. | 439/541.5 |
| 6,659,806 | B2 * | 12/2003 | Shi et al. | 439/676 |
| 6,743,047 | B2 * | 6/2004 | Korsunsky et al. | 439/540.1 |
| 2004/0018772 | A1 | 1/2004 | Zhang et al. | |
| 2004/0157491 | A1 | 8/2004 | Lin | |
| 2006/0030212 | A1 | 2/2006 | Harubayashi | |
| 2009/0209130 | A1 | 8/2009 | Kameyama et al. | |
| 2009/0305555 | A1 | 12/2009 | Wang et al. | |

FOREIGN PATENT DOCUMENTS

| | | |
|---|---|---|
| JP | 1990-150682 | 12/1990 |
| JP | 08-106961 | 4/1996 |
| JP | 2009-193858 | 8/2009 |
| JP | 2011-060613 | 3/2011 |
| WO | 01/06603 | 1/2001 |

OTHER PUBLICATIONS

China Official Action/Search Report and English language translation thereof, mail date is Jan. 16, 2015.

* cited by examiner

CONNECTOR AND ELECTRONIC DEVICE

TECHNICAL FIELD

The present invention relates to a connector for making an electric connection and to an electronic device equipped with the connector.

BACKGROUND ART

The connector disclosed in Patent Literature 1 is a known conventional technology. FIG. 1 is an exploded perspective view of the connector disclosed in Patent Literature 1. As shown in FIG. 1, a connector 40 includes a main housing 1, a connector housing 2, an inner shield case 3, and an outer shield case 5. The inner shield case 3 is inserted into the connector housing 2, which is made of an insulator. The connector housing 2 is then inserted into the main housing 1. Projections 19*a* and 19*b* formed on the connector housing 2 fit into respective grooves 10*a* and 10*b* in the main housing 1, thereby securing the connector housing 2 to the main housing 1. The outer shield case 5 is mounted to cover the main housing 1. With this configuration, the connector 40 achieves a double shield structure.

Patent literature 1: Japanese Patent Application Laid Open No. H8-106961

DISCLOSURE OF THE INVENTION

Problems to be Solved by the Invention

According to Patent Literature 1, a plate-type plug contact portion 4 is formed in the connector housing 2. Connecting portions 4*a* are formed on both faces of the plug contact portion 4. The connecting portions 4*a* on both faces have mutually parallel arrays of pluralities of upper terminals 12 and lower terminals 13, which are strips of conductive segments.

If the mating plug-type connector to be engaged with has a flat insulating plate with connecting portions on both of its faces, forming mutually parallel arrays of pluralities of upper terminals and lower terminals, which are strips of conductive segments, the plug contact portion 4 cannot be configured as described above. In order to make a connection with the plug-type connector of that type, the upper terminals 12 and lower terminals 13 are disposed on the inner upper wall and lower wall of the connector housing 2. The inner shield case 3 is disposed to cover the outer walls of the connector housing 2 so that it does not come into contact with the upper terminals 12 and lower terminals 13. In that configuration, however, the projections 19*a* and 19*b* are covered by the inner shield case 3, and the projections 19*a* and 19*b* cannot fit into the respective grooves 10*a* and 10*b* in the main housing 1. Thus, the connector housing 2 cannot be secured to the main housing 1. If large tabs are provided in the inner shield case 3 and fit into the grooves 10*a* and 10*b* instead of the projections 19*a* and 19*b*, the tabs could lower the shielding effect. Also, if the inner shield case 3 has large openings to expose the projections 19*a* and 19*b* of the connector housing 2, the openings could lower the shielding effect.

An object of the present invention is to provide a connector in which a connector member is secured to a case and a shielding effect can be maintained even if the mating plug-type connector to be engaged with has a flat insulating plate with connecting portions on both of its faces, forming mutually parallel arrays of pluralities of upper terminals and lower terminals, which are strips of conductive segments.

Means to Solve the Problems

To solve the problems described above, a connector according to a first embodiment of the present invention includes a connector member and a case. The connector member includes a body, a plurality of contacts, and an inner shield cover. The body is made of an insulator and has an insertion opening into which the mating plug-type connector can be inserted, in its fore part, and an insertion space is formed to extend from the insertion opening toward the back. The contacts are arranged on inner walls of the insertion space of the body. Each contact includes a contact portion which comes into contact with a contact of the mating plug-type connector, a first terminal portion which becomes a terminal to a printed circuit board when the connector is mounted on the board, and a trunk portion which connects the contact portion and the first terminal portion. The inner shield cover includes a cover portion which covers the outer walls of the body, second terminal portions which become terminals to the board when the connector is mounted on the board, and engaging portions having press-fractured faces, formed in the rear end. The case is made of a tube-shaped insulator; portions of its inner walls are formed to cover the outer walls of the connector member; resin springs are disposed inside the tube-shaped insulator and extend toward the back; and fixing stops are disposed at free ends of the resin springs, and their thickness increases inward from back to front. When the connector member is inserted into the case from the back of the case, the resin springs are opened out elastically; when the connector member is inserted until the fixing stops reach the engaging portions, the resin springs restore their original states, and the fixing stops engage with the engaging portions of the inner shield cover.

Effects of the Invention

In the connector according to the present invention, since the fixing stops of the case engage with the engaging portions of the inner shield cover, the connector member is tightly secured to the case and a high shielding effect is provided, without providing a large opening or a large tab in the inner shield cover.

BEST MODES FOR CARRYING OUT THE INVENTION

Now, an embodiment of the present invention will be described in detail.

First Embodiment

[Connector 100]

Figure 1:
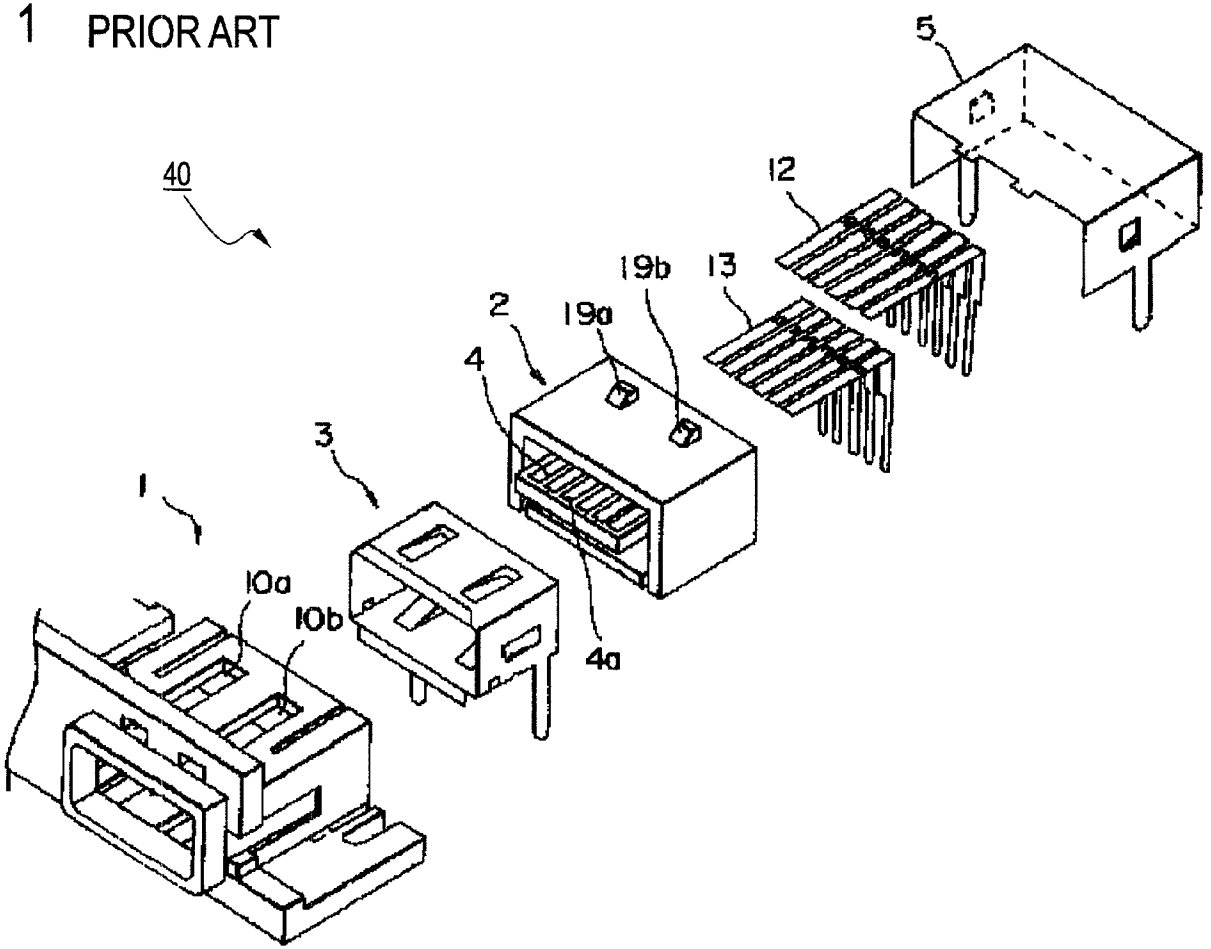
FIG. 1 PRIOR ART
FIG. 1 is an exploded perspective view of a connector 40 in Patent Literature 1.
Figure 2:
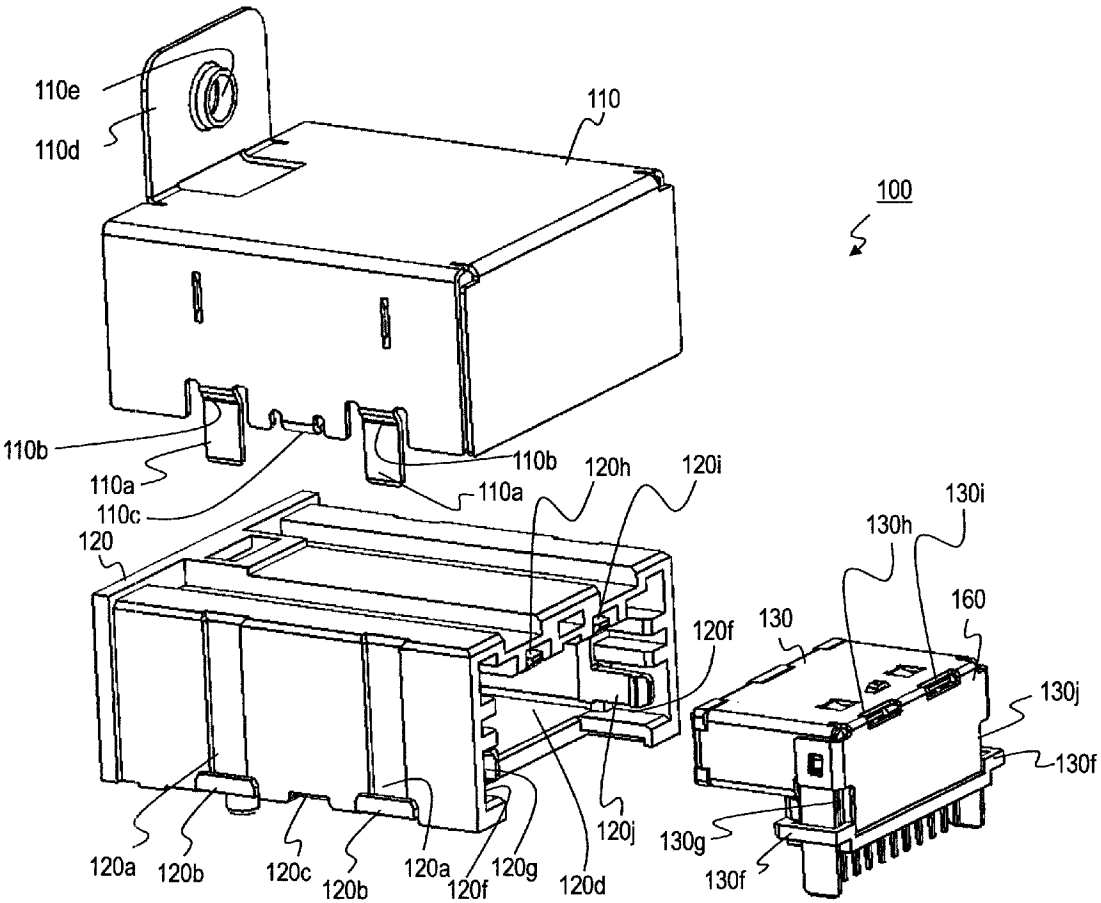
FIG. 2 is an exploded perspective view showing an example configuration of a connector 100.
Figure 3:
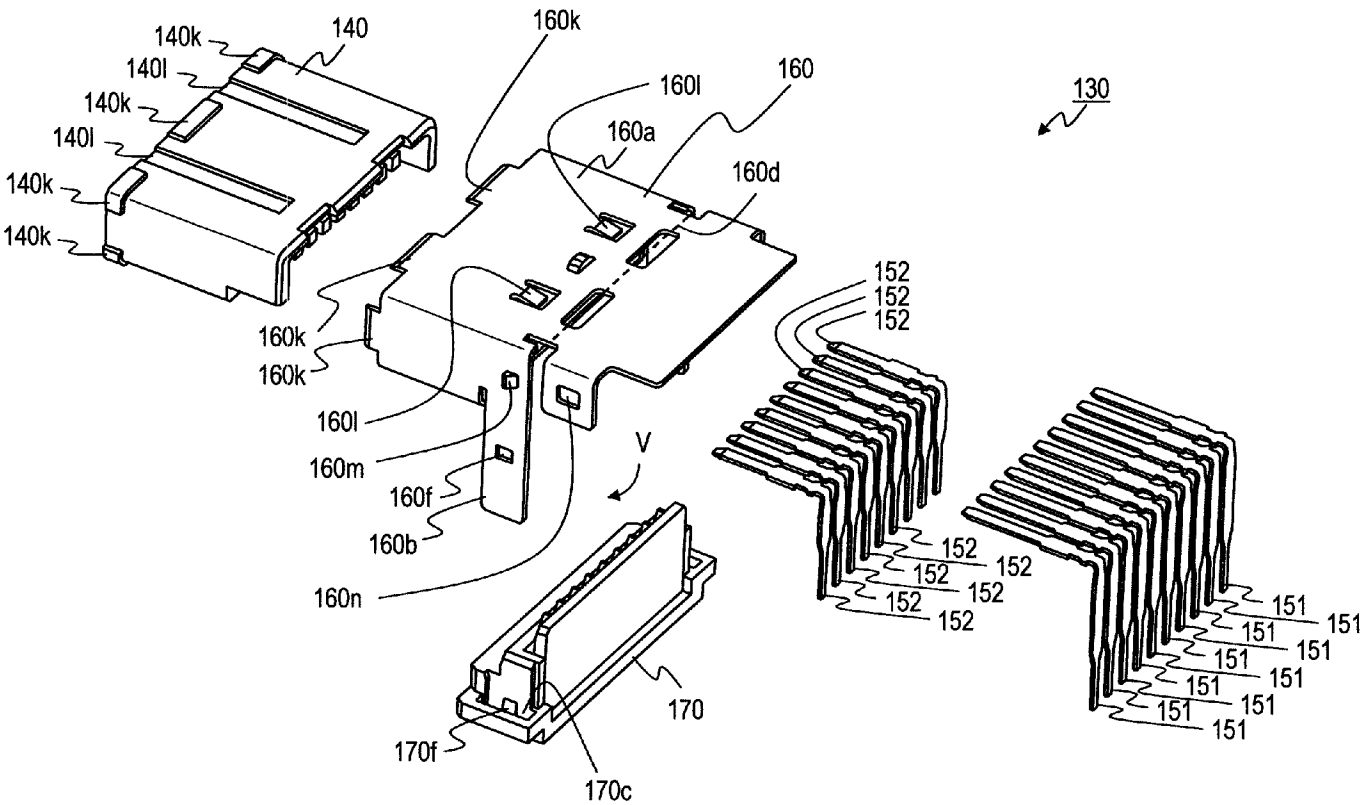
FIG. 3 is an exploded perspective view showing an example configuration of a connector member 130.

FIG. 2 shows a connector 100 according to a first embodiment. As shown in FIG. 2, the connector 100 includes an outer shield case 110, a case 120, and a connector member 130. As shown in FIG. 3, the connector member 130 includes a body 140, a plurality of contacts 151 and 152, an inner shield cover 160, and a spacer 170.

As shown in FIG. 2, resin springs 120*g*, 120*h*, 120*i*, and 120*j* are formed in the case 120. In the inner shield cover 160 of the connector member 130, engaging portions 130*g*, 130*h*, 130*i*, and 130*j* having press-fractured faces are formed. At the free ends of the resin springs 120*g*, 120*h*, 120*i*, and 120*j* of the case 120, fixing stops whose thickness increase inward from back to front are integrally formed. Therefore, when the connector member 130 is inserted into the case 120 from the back of the case 120, the resin springs 120*g*, 120*h*, 120*i*, and 120*j* are elastically opened out. They restore their original state after the connector member 130 reaches a given position. Then, the fixing stops engage with the engaging portions 130*g*, 130*h*, 130*i*, and 130*j* of the inner shield cover 160. Each part of the connector 100 will be described below in detail. In this embodiment, the front of the connector 100 is the face from which the mating plug-type connector to be engaged with is inserted; the bottom is the face at which the connector 100 is mounted on a printed circuit board; the front part and the lower part are respectively the fore part and the bottom part seen from the center of the connector 100.

[Body 140]

Figure 4A:
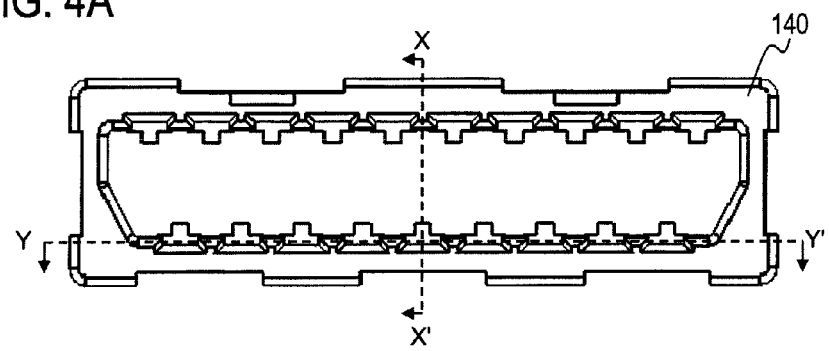
FIG. 4A is a front view of a body 140.
Figure 4B:
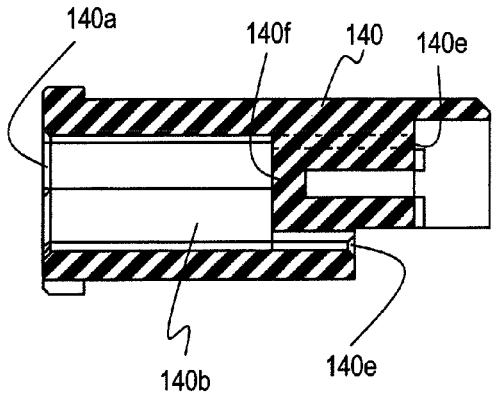
FIG. 4B is a cross-sectional view along a line X-X' in FIG. 4A.
Figure 4C:
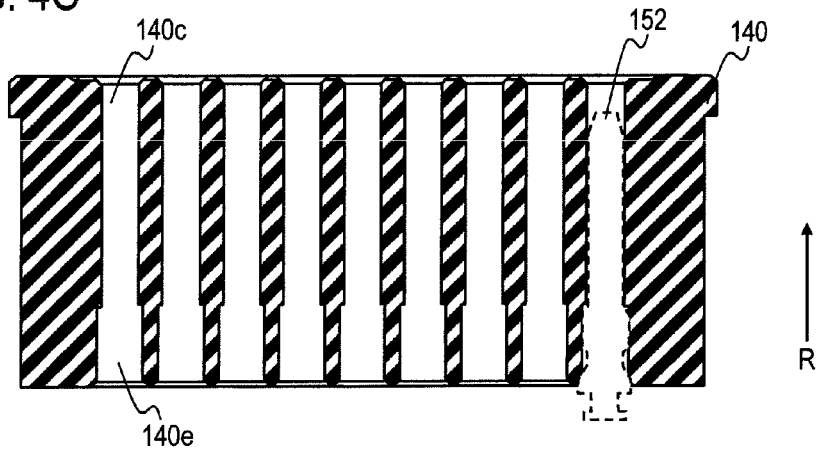
FIG. 4C is a cross-sectional view along a line Y-Y' in FIG. 4A.

As shown in FIGS. 4A to 4C, the body 140 is made of an insulator and has an approximately rectangular box shape. In the body 140, an insertion opening 140*a*, an insertion space 140*b*, and a plurality of holes 140*e* are formed (see FIG. 4B). The insertion opening 140*a* is formed in the front part of the body 140 so that the mating plug-type connector to be engaged with can be inserted. The insertion space 140*b* is formed to extend from the insertion opening 140*a* toward a rear wall 140*f*. The plurality of holes 140*e* are formed in the rear wall 140*f* to allow the plurality of contacts to individually pass through. In FIG. 4B, the holes 140*e* for upper contacts 151, which will be described later, are indicated by broken lines.

The contacts, which will be described later, are disposed on the upper wall and the lower wall of the inner surfaces of the insertion space 140*b* of the body 140. For example, as shown in FIG. 4C, a plurality of contact grooves 140*c* individually corresponding to a plurality of lower contacts 152, which will be described later, are formed in the lower wall of the inner surfaces of the body 140. The contact grooves 140*c* are provided at regular intervals, extend in parallel from the insertion opening 140*a* to the rear wall 140*f*, and are connected to the holes 140*e*.

[Contacts]

Figure 5:
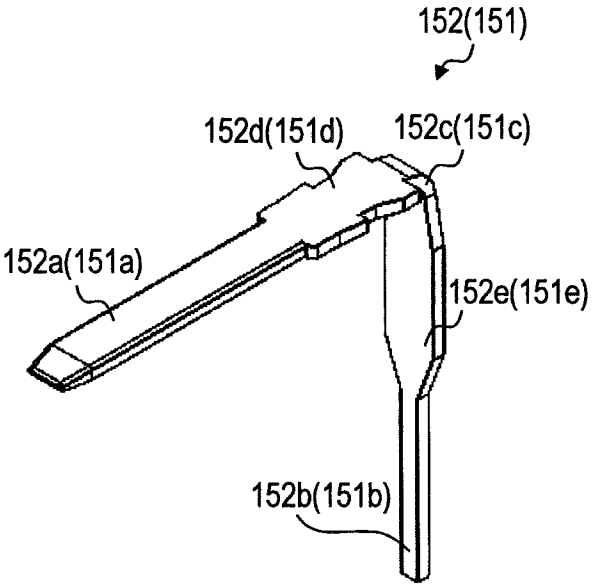
FIG. 5 is a perspective view of a lower contact 152.

The plurality of contacts include one or more upper contacts 151 disposed on the upper wall of the inner surfaces of the insertion space in the body 140 and one or more lower contacts 152 disposed on the lower wall of the inner surfaces of the insertion space in the body 140 (see FIG. 3). The upper contacts 151 and the lower contacts 152 are made of a plate-type conductor. These contacts have similar structures, as shown in FIG. 5, and differ in the lengths of individual portions. The lower contact 152 includes a contact portion 152*a*, a first terminal portion 152*b*, and a trunk portion 152*c*. The contact portion 152*a* comes in contact with a contact of the mating plug-type connector. The first terminal portion 152*b* becomes a terminal to the board when mounted on the board. The trunk portion 152*c* connects the contact portion 152*a* and the first terminal portion 152*b*. The trunk portion 152*c* also includes a press-fit portion 152*d* connected to the contact pot 152*a* and a guide portion 152*e* connected to the first terminal portion 152*b*. The upper contact 151 also includes the corresponding portions 151*a*, 151*b*, 151*c*, 151*d*, and 151*e*, as indicated in parentheses in FIG. 5.

The contact portions 151*a* and 152*a* of the plurality of contacts 151 and 152 are individually disposed in the contact grooves 140*c* formed in the upper wall and lower wall of the inner surfaces of the insertion space 140*b* of the body 140.

The contact portion 152*a* of the lower contact 152 is press-fitted from the back of the body 140 toward the front (direction indicated by an arrow R in FIG. 4C), through the hole 140*e* (see FIG. 4B) (see FIG. 4C, where the rightmost lower contact 152 is indicated by a broken line for the sake of explanation). The press-fit portion 152*d* is formed to increase in width from front to back (see FIG. 5). After the press-fit portion 152*d* is press-fitted into the hole 140*e* and the lower contact 152 is inserted into the body 140, this shape prevents the lower contact 152 from falling out toward the back. The contact portion 152*a* is disposed in the contact groove 140*c*. The upper contacts 151 are disposed in the upper wall of the inner surfaces of the body 140 in the same manner.

Figure 6A:
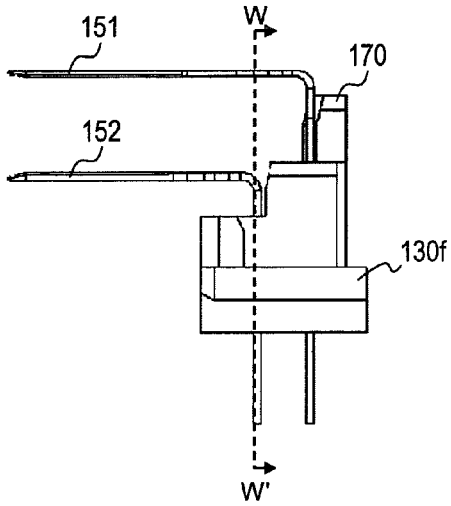
FIG. 6A is a right side view showing an upper contact 151 and the lower contact 152 guided by a spacer 170.
Figure 6B:
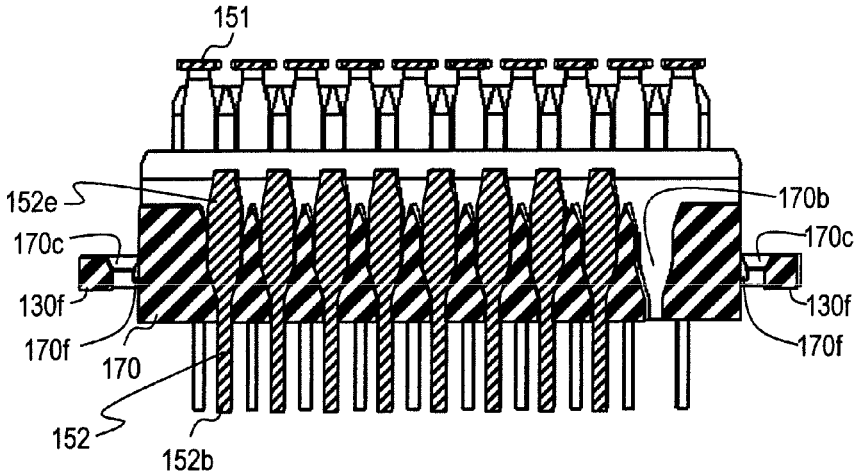
FIG. 6B is a cross-sectional view along a line W-W' in FIG. 6A.

The trunk portion 152*c* is bent toward the mounting face (in the direction indicated by an arrow V in FIG. 3) at the back of the body 140. The first terminal portions 152*b* of the lower contacts 152 arranged as shown in FIGS. 6A and 6B are guided to given positions by the spacer 170. The guide portion 152*e* of the lower contact 152 has a portion reduced in width from top to bottom (FIG. 5). The spacer 170 has flat plate-shaped holes 170*b* (see FIG. 6B, in which the rightmost lower contact 152 is hidden for the sake of explanation). The hole 170*b* is formed to reduce in width from top to bottom and to come into contact with the first terminal portion 152*b* at its end. When the first terminal portion 152*b* of the lower contact 152 is inserted into the hole 170*b* from above the spacer, the first terminal portion 152*b* is guided to the position where the guide portion 152*e* engages with the hole 170*b* (see FIG. 6B). The upper contacts 151 are disposed in the same manner.

[Inner Shield Cover 160]

Figure 7:
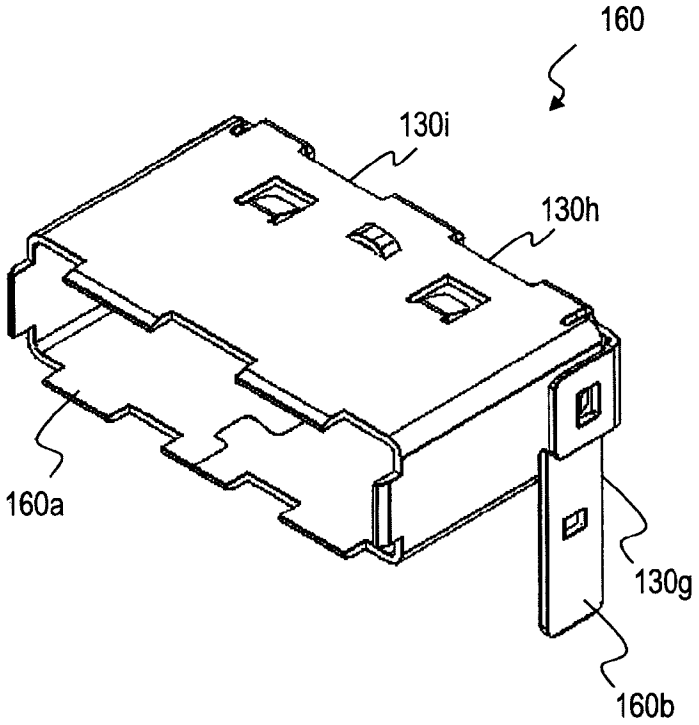
FIG. 7 is a perspective view of an inner shield cover 160.

As shown in FIGS. 2 and 7, the inner shield cover 160 includes a cover portion 160*a*, second terminal portions 160*b*, and engaging portions 130*g*, 130*h*, 130*i*, and 130*j*. The cover portion 160*a* covers the outer faces of the body 140. The two second terminal portions 160*b* become terminals to the board when mounted on the board. The engaging portions 130*g*, 130*h*, 130*i*, and 130*j* are formed in the rear end. The rear end includes press-fractured faces.

The inner shield cover 160 is bent at the rear end of the body 140 perpendicularly to the direction in which the mating plug-type connector is inserted and toward the mounting face. The inner shield cover 160 is bent at a 90-degree angle along a broken-line portion 160*d* in the direction indicated by the arrow V.

The inner shield cover 160 is formed by pressing a conductor such as a metal plate. Elongated holes which will serve as the engaging portions 130*h* and 130*i*; the engaging portions 130*g* and 130*j*; 160*l*, 160*m*, 160*n*, and 160*f*; and the like are also formed. The metal plate to be used as the material is placed on the metal die, and a punch is pressed against it to remove the inner shield cover 160 from the metal plate. The portions where it is removed from the metal plate have fracture faces having sharp edges. The removed inner shield cover 160 is bent at given positions to form a rectangular tube having two side faces, a top face, and a bottom face, as shown in FIG. 3. The body 140, the plurality of contacts 151 and 152, and the spacer 170 are inserted into the inner shield cover 160, and then, the back of the inner shield cover 160 is bent along the back end of the top face of the body 140 perpendicularly to the direction in which the mating plug-type connector is inserted and toward the mounting face (in the direction indicated by the arrow V in FIG. 3), to form the shape shown in FIG. 7.

[Spacer 170]

As shown in FIGS. 6A and 6B, the spacer 170 is made of an insulator and has a plurality of holes 170*b* corresponding to the plurality of first terminal portions 151*b* and 152*b* and two holes 170*c* corresponding to the two second terminal portions 160*b*. The holes 170*b* and 170*c* pass through the spacer 170 vertically. Engaging portions 130*f* are formed by making through holes 170*c* in plate portions that extend sideways. When the first terminal portions 151*b* and 152*b* and the second terminal portions 160*b* are inserted into the spacer 170 from top to bottom, the holes 170*b* and 170*c* guide the first terminal portions 151*b* and 152*b* and the second terminal portions 160*b* to given positions, respectively. In this way, the spacer 170 keeps such spacings that the upper contacts 151, the lower contacts 152, and the inner shield cover 160 are kept separated.

[Assembly of the Connector Member 130]

The connector member 130 includes the body 140, the plurality of contacts 151 and 152, the inner shield cover 160, and the spacer 170, as described earlier (see FIG. 3). First, the body 140 is inserted into the rectangular tube part formed by the cover portion 160*a* of the inner shield cover 160. Then, the contacts 151 and 152 are press-fitted into the body 140 from the back thereof. The trunk portions 151*c* and 152*c* of the contacts 151 and 152 are bent in the direction indicated by the arrow V in FIG. 3 (the direction perpendicular to the direction of insertion and toward the mounting face). The first terminal portions 151*b* and 152*b* of the contacts 151 and 152 and the second terminal portions 160*b* of the inner shield cover 160 are inserted into the spacer 170 from above thereof to dispose the first terminal portions 151*b* and 152*b* and the second terminal portions 160*b* in given positions. The inner shield cover 160 is then bent in the direction indicated by the arrow V in FIG. 3 at the rear end of the body 130. In this way, the connector member 130 is assembled (see FIG. 2).

The body 140 has a plurality of guard portions 140*k* protruding outward at its front end, as shown in FIG. 3. The inner shield cover 160 has a plurality of convex portions 160*k* protruding forward at its front end, each convex portion corresponding to each concave portion formed between the adjacent guard portions 140*k*. In the top face of the body 140, two grooves 140*l* are formed from the front end toward the back. The grooves 140*l* do not reach the back end of the body 140 and have their ends in the top face of the body 140. In the top face of the inner shield cover 160, two tab portions 160*l* are formed and pulled down. When the body 140 is inserted into the rectangular tube part formed by the cover portion 160*a* of the inner shield cover 160, the guard portions 140*k* mesh with the convex portions 160*k*. This structure secures the body 140 and the inner shield cover 160 vertically and horizontally. When the body 140 is inserted, the tab portions 160*l* are elastically opened out (upward). When the tab portions 160*l* reach the grooves 140*l* in the top face of the body 140, the tab portions 160*l* restore their original states. The guard portions 140*k* provided in the front end of the body 140 engage with the front end of the inner shield cover 160, and the ends of the grooves 140*l* provided in the top face of the body 140 engage with the tab portions 160*l* of the inner shield cover, and consequently the body 140 and the inner shield cover 160 are secured in the longitudinal direction.

Fitting holes 160*f* are formed in the upper parts of the second terminal portions 160*b* of the inner shield cover 160, as shown in FIG. 3. In the inner faces of the holes 170*c* of the spacer 170, projections 170*f* increasing in thickness from top to bottom are formed (see FIG. 6B). When the second terminal portions 160*b* of the inner shield cover 160 are inserted into the holes 170*c* from above the spacer 170, the projections 170*f* cause the second terminal portions 160*b* to elastically open outward. When the projections 170*f* reach the fitting holes 160*f*, the second terminal portions 160*b* restore their original states. This structure prevents the spacer 170 from falling down. The top of the spacer 170 comes into contact with the body 140 and the inner shield cover 160, and the inner shield cover 160 and the spacer 170 are secured vertically.

Tabs 160*m* are formed at the side faces of the cover portion 160*a* of the inner shield cover 160, as shown in FIG. 3, and holes 160*n* are formed at the back side faces. When the rear portion of the inner shield cover 160 is bent in the direction indicated by the arrow V in FIG. 3, the tab 160*m* fit in the holes 160*n*. This structure holds the inner shield cover 160 in the shape shown in FIG. 7.

[Case 120]

The case 120 is an insulator and has a rectangular tube shape. The case 120 has openings 120*e* and 120*d* which are connected. The opening 120*e* is formed in the fore part of the case 120 to become an insertion opening for the mating plug-type connector (see FIG. 8). The opening 120*d* is formed in the back part of the case 120 to become an insertion opening for the connector member 130 (see FIG. 2).

Figure 9:
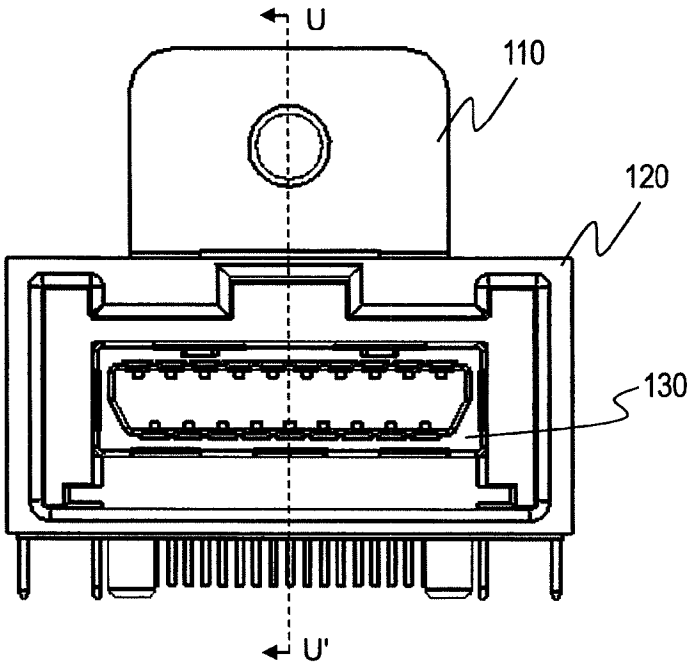
FIG. 9 is a front view of the connector 100.
Figure 10A:
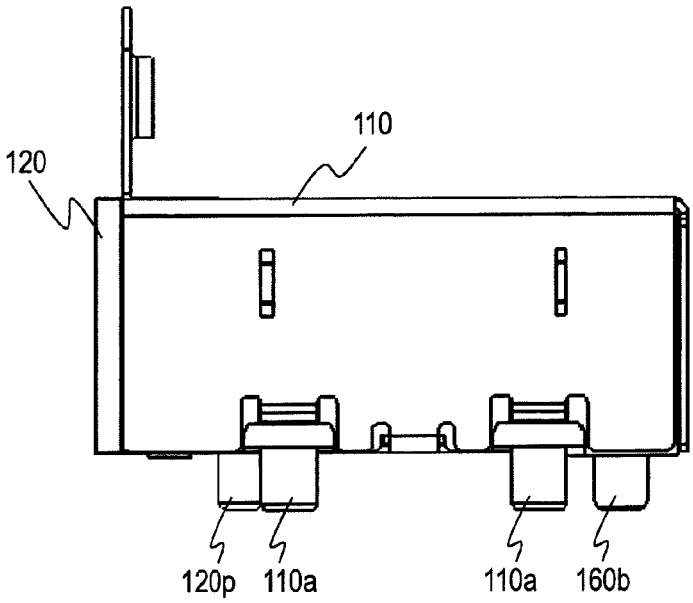
FIG. 10A is a right side view of the connector 100.
Figure 10B:
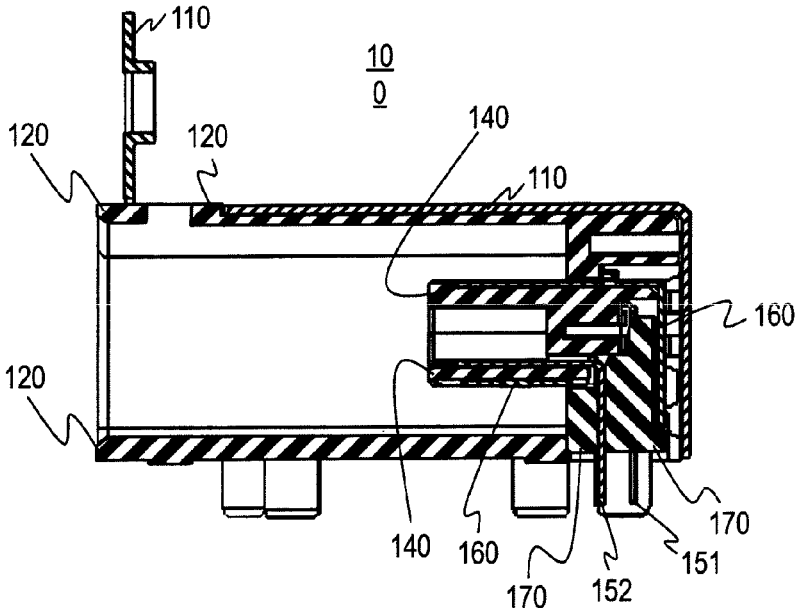
FIG. 10B is a cross-sectional view along a line U-U' in FIG. 9.

The case 120 is formed so that portions of its inner walls cover the outer walls of the connector member 130, as shown in FIGS. 9, 10A, and 10B.

Figure 11A:
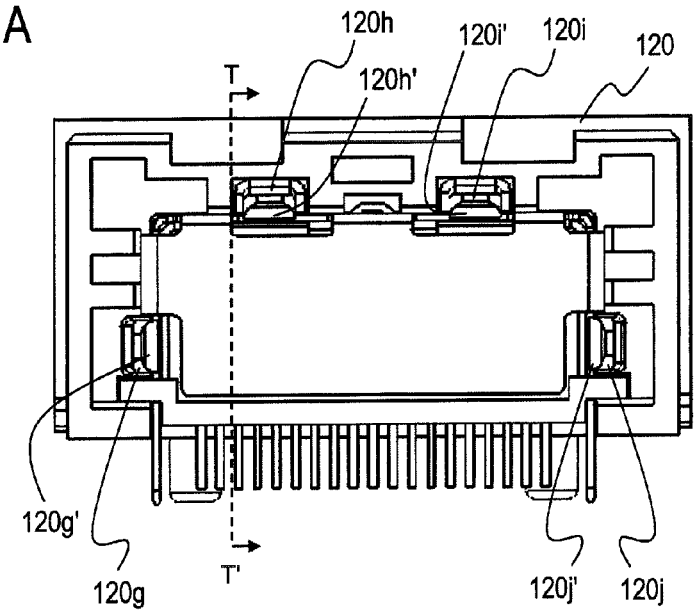
FIG. 11A is a rear view of the connector 100 without an outer shield case 110.
Figure 11B:
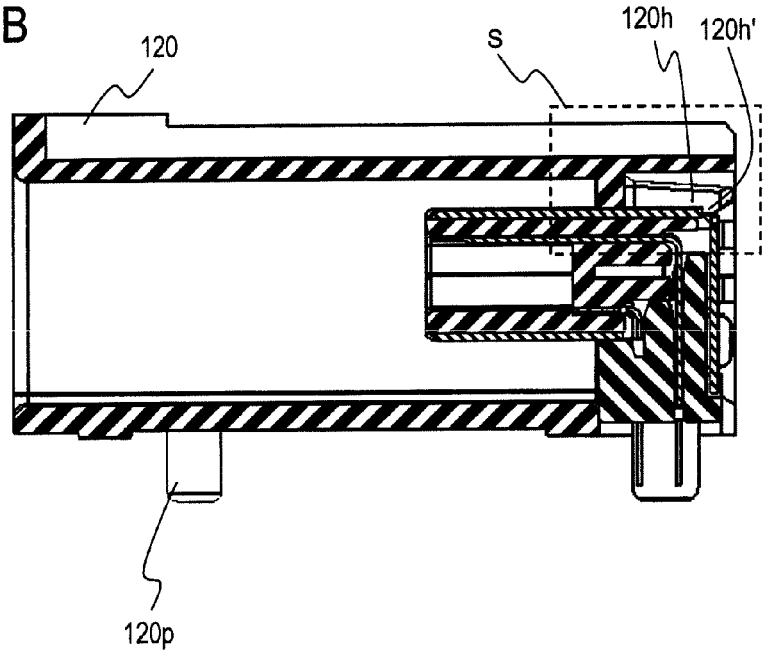
FIG. 11B is a cross-sectional view along a line T-T' in FIG. 11A.
Figure 12:
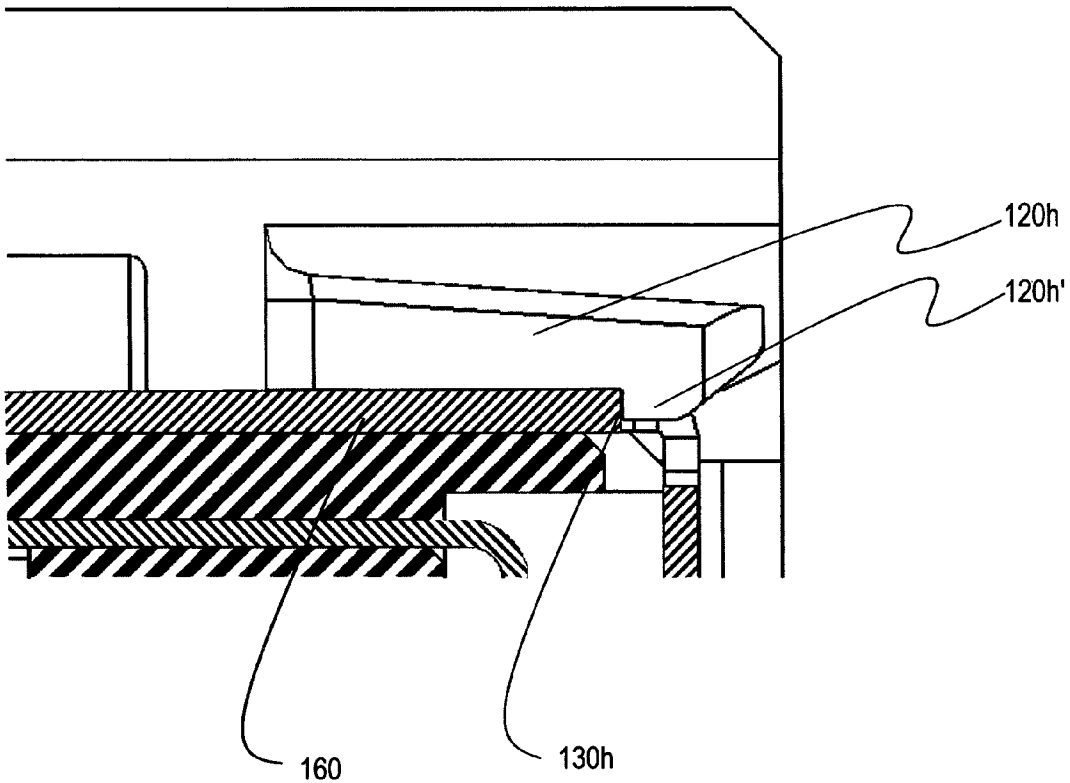
FIG. 12 is an enlarged view of an area S in FIG. 11B.
Figure 13:
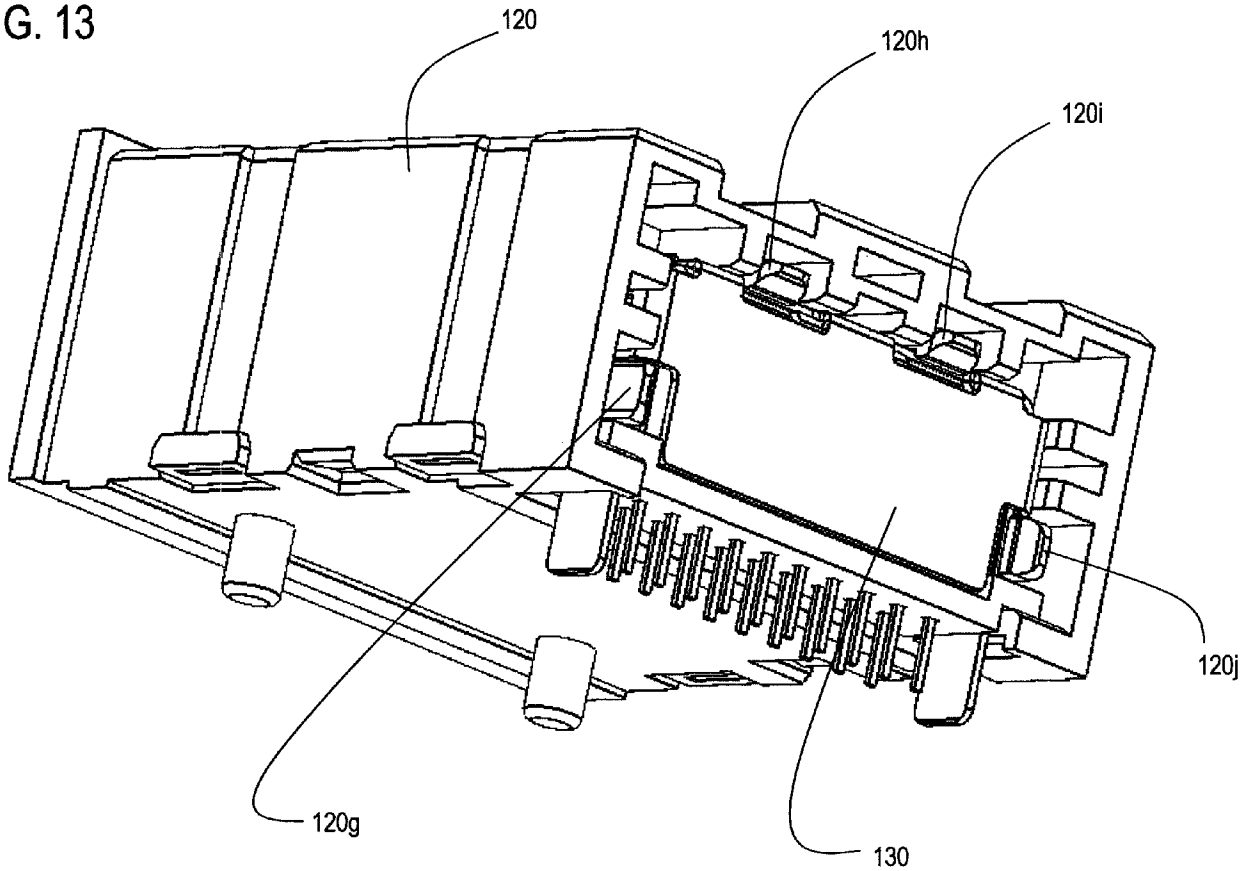
FIG. 13 is a perspective view showing the right side, back, and bottom of the connector 100 without the outer shield case 110.

The case 120 has resin springs 120*g*, 120*h*, 120*i*, and 120*j* integrally formed with fixing stops 120*g*', 120*h*, 120*i*', and 120*j*', respectively, as shown in FIGS. 11A, 11B, and 12. The resin springs 120*g*, 120*h*, 120*i*, and 120*j* are disposed inside the case and extend backward. The fixing stops 120*g*', 120*h*', 120*i*', and 120*j*' are disposed at the free ends of the resin springs and increase in thickness inward from back to front. FIG. 12 shows the shapes of the resin spring 120*h* and the fixing stop 120*h*'. The resin springs 120*g*, 120*i*, and 120*j* have the same shape as the plastic spring 120*h*, and the fixing stops 120*g*', 120*i*', and 120*j*' have the same shape as the fixing stop 120*h*'.

Slits 120*f* are formed below the resin springs 120*g* and 120*j* in the inner walls of the case 120 (see FIG. 2).

When the connector member 130 is inserted into the case 120 from the back thereof (see FIG. 2), the front edge of the connector member 130 engages with the fixing stops 120*g*', 120*i*', 120*j*', and 120*h*' of the case 120, and the resin springs 120*g*, 120*h*, 120*i*, and 120*j* of the case 120 are opened out elastically. After the connector member 130 reaches a given position, the resin springs 120*g*, 120*h*, 120*i*, and 120*j* restore their original states (see FIGS. 11A, 11B, 12, and 13). The given position is reached, for example, when the connector member 130 is inserted until the fixing stops 120*g*', 120*h*', 120*i*', and 120*j*' reach the respective engaging portions 130*g*, 130*h*, 130*i*, and 130*j* of the inner shield cover 160. The fixing stops 120*g*', 120*h*', 120*i*', and 120*j*' stop in an engaged state in the engaging portions 130*g*, 130*h*, 130*i*, and 130*j* of the inner shield cover 160 (see FIG. 12). The engaging portions 130*f* formed in the spacer 170 included in the connector member 130 are inserted into the slits 120*f* (see FIG. 2). The front edges of the engaging portions 130*f* come into contact with the ends of the slits 120*f*. With this structure, the connector member 130 is secured to the case 120 longitudinally, horizontally, and vertically. The connector member 130 is secured to the case 120 longitudinally by the back face of the case 120, the slits 120*f*, the fixing stops 120*g*', 120*h*', 120*i*', and 120*j*', the front face of the connector member 130, the engaging portions 130*f*, and the engaging portions 130*g*, 130*h*, 130*i*, and 130*j*. The connector member 130 is secured to the case 120 vertically and horizontally by the inner walls of the case 120 and the outer walls of the connector member 130.

Since the press-fractured faces are substantially flat, the engagement allowance of the fixing stops 120*g*', 120*h*', 120*i*', and 120*j*' can be reduced. For example, if the fixing stops 120*g*', 120*h*', 120*i*', and 120*j*' engage with bends in the rear end of the inner shield cover 160 instead of the press-fractured faces, a larger engagement allowance is required because of the radius of curvature of the bends, in comparison with when the fixing stops engage with the flat press-fractured faces. In addition, the bends are likely to vary in position or in angle. The variations will lead to unsteadiness in engagement of the fixing stops 120*g*', 120*h*', 120*i*', and 120*j*'. In contrast, the press-fractured faces can be precisely formed, and therefore, such a problem does not occur. By reducing the engagement allowance of the fixing stops 120*g*', 120*h*', 120*i*', and 120*j*', the distance over which the fixing stops are guided toward the rear part of the connector member 130 can be reduced. Consequently, the overall length of the connector 100 can be reduced, and the size can be reduced.

[Outer Shield Case 110]

The outer shield case 110 is a conductor and has a rectangular box shape, as shown in FIGS. 2, 10A, and 10B. The outer shield case 110 covers the outer walls of the case 120, excluding the front and bottom faces of the case 120. A plurality of step portions 110*b* and a plurality of third terminal portions 110*a* are formed in both side faces of the outer shield case 110. The step portion 110*b* is bent inward and then bent downward in parallel with the side face. The third terminal portion 110*a* extends downward from the step portion 110*b*. The third terminal portions 110*a* slide downward in guide grooves 120*a* extending vertically in both side faces of the case 120, and the step portions 110*b* engage with supporting portions 120*b*. The outer shield case 110 is secured to the case 120 longitudinally by the third terminal portions 110*a* fitting in the guide grooves 120*a*. The outer shield case 110 is secured to the case 120 horizontally by the third terminal portions 110*a* engaging with the supporting portions 120*b*.

Engaging stops 110*c* of the outer shield case 110 are bent inward. When the engaging stops 110*c* engage with engaging portions 120*c* of the case 120, the assembly is completed. The outer shield case 110 is secured to the case 120 vertically.

This configuration provides a double shield structure and improves the shielding effect.

[Electronic Device 200 Equipped with the Connector 100]

Figure 8:
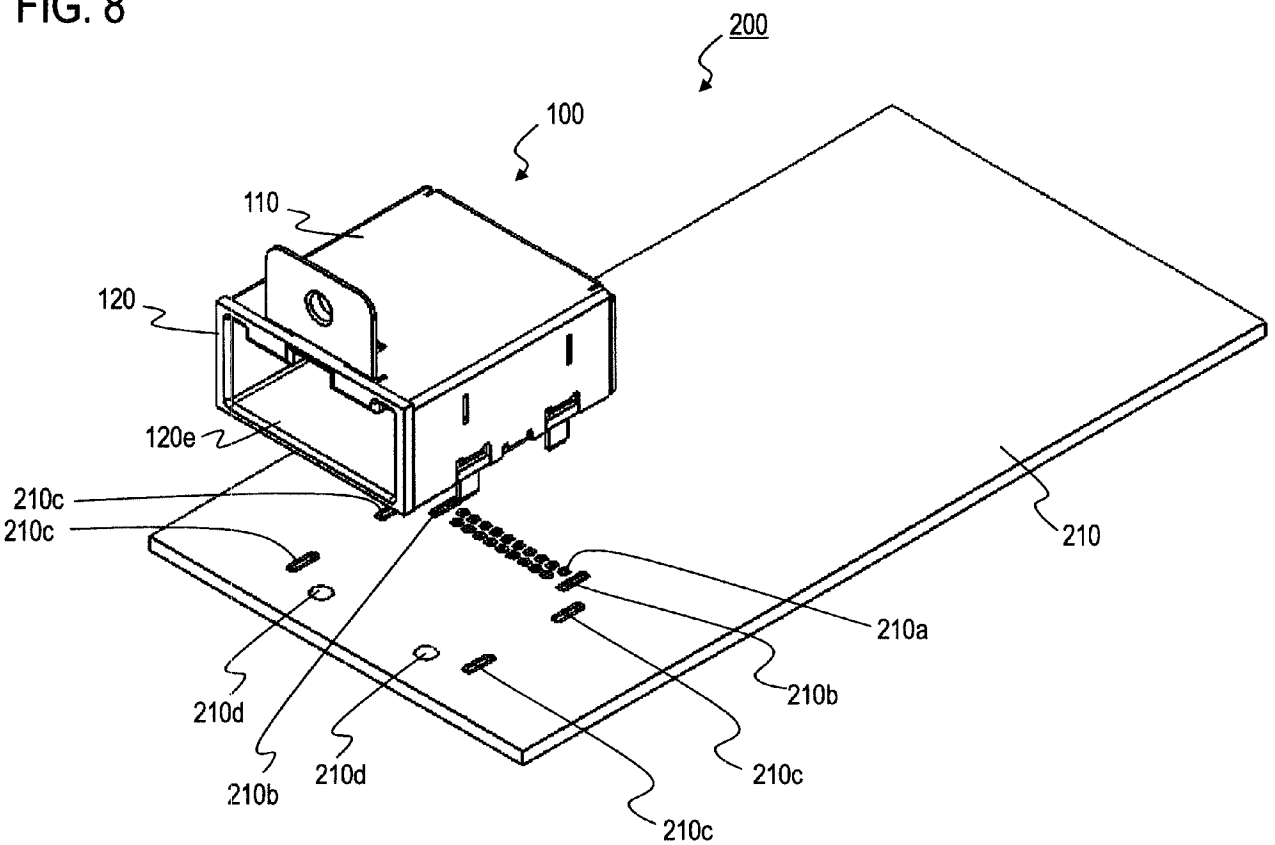
FIG. 8 is a diagram illustrating how the connector 100 is disposed on a printed circuit board 210 of an electronic device 200.

The connector 100 is mounted on a printed circuit board 210 of an electronic device 200 as shown in FIG. 8. The board 210 of the electronic device 200 has first through-holes 210*a* into which the first terminal portions 151*b* and 152*b* are inserted, second through-holes 210*b* into which the second terminal portions 160*b* are inserted, third through-holes 210*c* into which the third terminals 110*a* are inserted, and printed wiring. At least as many through-holes as corresponding terminal portions are provided.

The connector 100 is secured to the board 210 longitudinally, horizontally, and vertically when the first terminal portions 151*b* and 152*b* and the second terminal portions 160*b* are individually soldered onto the board 210. The second terminal portions 160*b* and third terminals 110*a* are grounded via the second through holes 210*b* and the third through holes 210*c*, respectively. The first contact portions 151*b* and 152*b* are connected to wiring via the first through-holes 210*a*.

Projecting portions 120*p* are formed in the front part of the bottom face of the case 120 (see FIG. 10A). Fourth through-holes 210*d* into which the projecting portions 120*p* are inserted are formed in the board 210 (see FIG. 8). The connector 100 can be secured to the board 210 longitudinally and horizontally by inserting the projecting portions 120*p* into the fourth through-holes 210*d*. With this structure, when the mating plug-type connector is attached or detached, the loads exerted on the terminal portions can be reduced.

The outer shield case 110 has a flange 110*d* extending upward in its front end, as shown in FIG. 2. The flange 110*d* may have a threaded hole 110*e* at its center. If the threaded hole 110*e* is provided, the connector 100 can be fastened to a housing (not shown) of the electronic device 200 by a screw. The outer shield case 100 is grounded with the housing through the flange 110*d*.

[Effects]

With the configuration described above, even if the mating plug-type connector includes a flat insulating plate with connecting portions on both of its faces, which connecting portions include mutually parallel arrays of pluralities of upper terminals and lower terminals, which are strips of conductive segments, the portions in contact with the mating plug-type connector can be covered by the inner shield cover 160. Therefore, the connector 100 can maintain a high shielding effect. The fixing stops of the case 120 engage with the engaging portions of the inner shield cover 160 having press-fractured faces, and the position of the contained connector member 130 is secured. Therefore, the need to provide a large tab or a large hole in the inner shield is eliminated, and the body 140 does not have to be exposed. The back end of the inner shield case 3 in Patent Literature 1 is open so that the upper terminals and lower terminals can pass through. Since the inner shield cover 160 of the connector 100 covers all of the contacts from the outside, the inner shield cover 160 does not require an open back end, and the shielding effect is improved.

[Other Modifications]

The resin springs and fixing stops of the case 120 need to be provided at least on either side wall of the inner faces of the case 120 and at least on either the upper wall or the lower wall of the inner faces, and engaging portions need to be provided at least in the corresponding positions of the connector member 130.

When the connector member 130 is assembled, the contacts may be press-fitted into the body 140 after the trunk portions 151*c* and 152*c* of the contacts are bent.

The embodiment of the present invention is provided merely for the purpose of illustration and description. It is not intended to be comprehensive, nor is it intended to confine the present invention strictly to the disclosed style. Therefore, modifications and variations can be allowed from the above-described teaching. The embodiment is a representation chosen to provide the best illustration of the principle of the present invention and to allow those skilled in the art to use the present invention in a variety of embodiments suited to carefully considered applications and to add a variety of modifications. All the modifications and variations are within the scope of the present invention determined by attached claims interpreted according to the range given fairly, legitimately, and impartially.

What is claimed is:

1. A connector comprising a connector member and a case, the connector member comprising:

a body being made of an insulator, having an insertion opening where a mating plug-type connector can be inserted, in a fore part of the body, and an insertion space extending from the insertion opening toward the back of the body;

a plurality of contacts being arranged on inner walls of the insertion space of the body, each comprising a contact portion which comes into contact with a contact of the mating plug-type connector;

a first terminal portion which becomes a terminal to a printed circuit board when the connector is mounted on the board; and a trunk portion which connects the contact portion and the first terminal portion; and an inner shield cover comprising a cover portion which covers the outer walls of the body;

second terminal portions which become terminals to the board when the connector is mounted on the board; and engaging portions having press-fractured faces, formed in a rear end of the inner shield cover;

the case being made of a tube-shaped insulator and having portions of the inner walls thereof formed to cover the outer walls of the connector member, resin springs disposed inside the tube-shaped insulator and extending toward the back of the case, and fixing stops disposed at free ends of the resin springs and increasing in thickness inward from back to front;

when the connector member is inserted into the case from the back of the case, the resin springs being opened out elastically, and when the connector member is inserted until the fixing stops reach the engaging portions, the resin springs restoring the original states thereof and the fixing stops engaging with the engaging portions of the inner shield cover, wherein the inner shield cover is bent at the rear end of the body in a direction perpendicular to an insertion direction of the mating plug-type connector and toward the mounting face.

2. The connector according to claim 1, wherein the connector member further comprises a spacer which is made of an insulator and keeps a spacing such that the contacts do not come into contact with the inner shield cover; and the contacts are press-fitted into the body, the trunk portions are bent in the rear part of the body toward the mounting face, and the first terminal portions are guided to given positions by the spacer.

3. The connector according to claim 1, further comprising an outer shield case that covers the outer walls of the case.

4. The connector according to claim 2, further comprising an outer shield case that covers the outer walls of the case.

5. An electronic device comprising a connector, the connector being mounted on a printed circuit board and comprising a connector member and a case, the connector member comprising:

a body being made of an insulator, having an insertion opening where a mating plug-type connector can be inserted, in a fore part of the body, and an insertion space extending from the insertion opening toward the back of the body;

a plurality of contacts being arranged on inner walls of the insertion space of the body, each comprising a contact portion which comes into contact with a contact of the mating plug-type connector;

a first terminal portion which becomes a terminal to a printed circuit board when the connector is mounted on the board; and a trunk portion which connects the contact portion and the first terminal portion; and an inner shield cover comprising a cover portion which covers the outer walls of the body;

second terminal portions which become terminals to the board when the connector is mounted on the board; and engaging portions having press-fractured faces, formed in a rear end of the inner shield cover;

the case being made of a tube-shaped insulator and having portions of the inner walls thereof formed to cover the outer walls of the connector member, resin springs disposed inside the tube-shaped insulator and extending toward the back of the case, and fixing stops disposed at free ends of the resin springs and increasing in thickness inward from back to front;

when the connector member is inserted into the case from the back of the case, the resin springs being opened out elastically, and when the connector member is inserted until the fixing stops reach the engaging portions, the resin springs restoring the original states thereof and the fixing stops engaging with the engaging portions of the inner shield cover, wherein the inner shield cover is bent at the rear end of the body in a direction perpendicular to the insertion direction of the mating plug-type connector and toward the mounting face.

6. The electronic device according to claim 5, wherein the connector member further comprises a spacer which is made of an insulator and keeps a spacing such that the contacts do not come into contact with the inner shield cover; and the contacts are press-fitted into the body, the trunk portions are bent in the rear part of the body toward the mounting face, and the first terminal portions are guided to given positions by the spacer.

7. The electronic device according to claim 5, further comprising an outer shield case that covers the outer walls of the case.

8. The electronic device according to claim 6, further comprising an outer shield case that covers the outer walls of the case.

* * * * *